US006053659A

United States Patent [19]

Burton et al.

[11] Patent Number: 6,053,659

[45] Date of Patent: Apr. 25, 2000

[54] INLAID BRICK WALKWAY BED LEVELER

[76] Inventors: Bruce A. Burton; Bruce H. Burton, both of Box 265, Pencil Mill Rd., Castleton, Vt. 05735

[21] Appl. No.: 09/229,062

[22] Filed: Jan. 12, 1999

[51] Int. Cl.[7] ..... E01C 19/44

[52] U.S. Cl. ..... 404/97; 15/235.8

[58] Field of Search ..... 15/235.4, 235.8; 404/97, 118

[56] References Cited

U.S. PATENT DOCUMENTS

| | | | |
|---|---|---|---|
| 1,498,066 | 6/1924 | Barth . | |
| 1,847,728 | 3/1932 | Schmid . | |
| 3,082,460 | 3/1963 | Haivala . | |
| 3,302,233 | 2/1967 | Sebastiani . | |
| 4,702,641 | 10/1987 | Naser et al. | 404/97 |
| 5,046,387 | 9/1991 | Levake | 81/489 |
| 5,234,281 | 8/1993 | Somero et al. | 404/84.5 |
| 5,609,437 | 3/1997 | Silva | 404/118 |

*Primary Examiner*—James A. Lisehora
*Attorney, Agent, or Firm*—John J. Welch, Jr., Esq.

[57] ABSTRACT

An inlaid brick walkway bed leveler consisting of a handle affixed to a rakehead with the handle being supported by a pair of equivalent mediolateral struts attached to the handle and the rakehead, a brace serving to support the struts, a straight bottom edge of the rakehead, the lateral aspects of the front face of the rakehead being amenable to receipt of snugly fitting, adjustable width gauge components with chair shaped ends each amenable to receipt of a clip component and to each of which width gauge components there is affixed a pair of threaded posts extending through elongated slits in the rakehead with an anteroposterior through hole medially positioned in the rakehead near the topside thereof and with there being affixed to the top side thereof just above the anteroposterior hole, an encased leveling bubble component.

10 Claims, 5 Drawing Sheets

INLAID BRICK WALKWAY BED LEVELER

CROSS REFERENCES TO PRIOR OR PARENT APPLICATIONS

Figure 1:
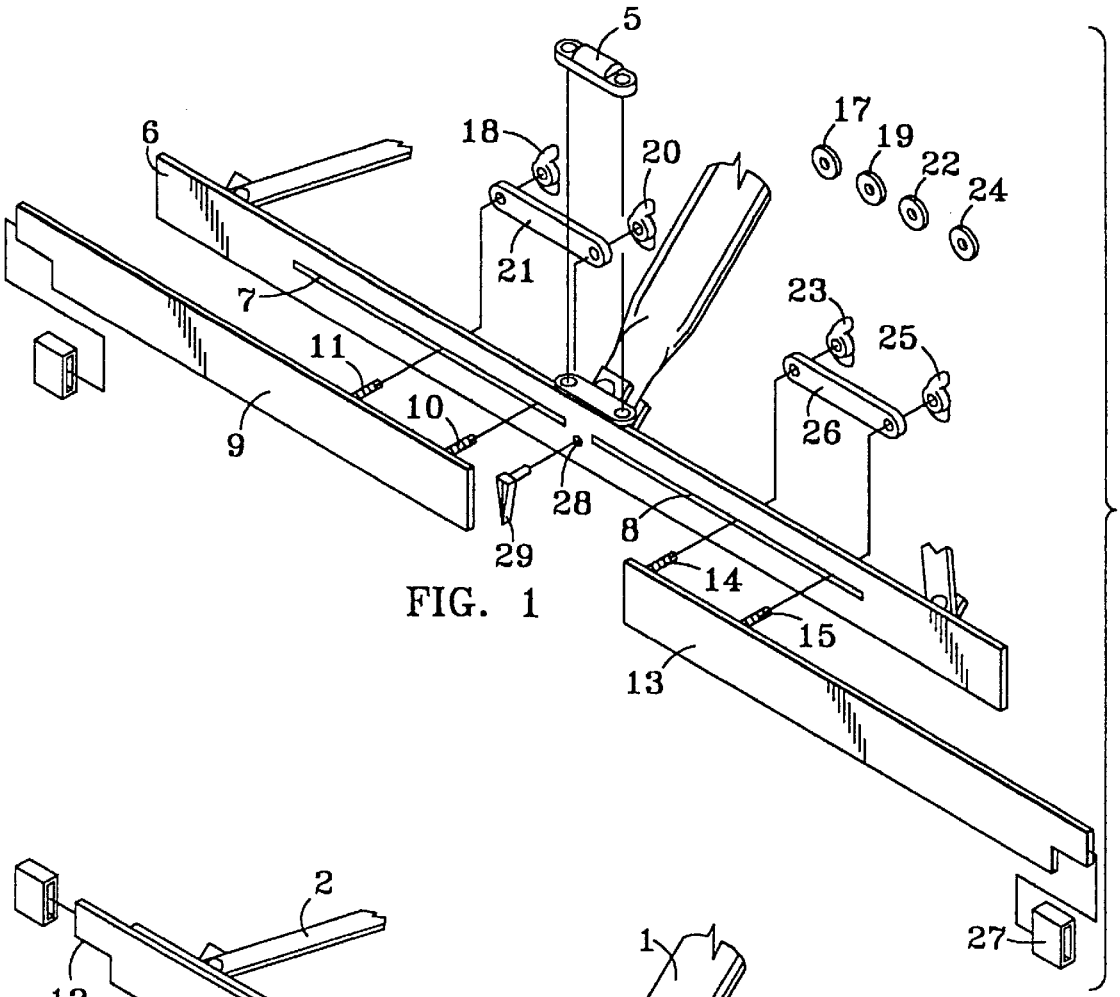

There are no prior or parent applications to which the instant invention relates.

FEDERALLY SPONSORED RESEARCH AND DEVELOPMENT

There is no federally sponsored research and development that relates to the instant invention.

BACKGROUND OF THE INVENTION

1. Field of the Invention

The instant invention relates to those sorts of devices such as are utilized to construct access routes to, from and about buildings.

2. Prior Art

The references set forth in the enclosed Informational Statement do not anticipate the invention.

A SUMMARY OF THE INVENTION

1. A Brief Description of the Invention

An elongated handle is angularly attached to a four sided rakehead component. A pair of support struts extend outwardly, one in a direction opposite to the other to form a locus on the body of the handle to which each is affixed to respective opposing locations on the rakehead equidistant from the point of attachment of the handle to the rakehead. A brace is affixed to equivalent and opposing points on each strut serving to stabilize their support of the handle as attached to the rakehead. The bottom side of the rakehead is the equivalent of a straight edge thereof for purposes of more readily ensuring a desired leveling of an inlaid brick walkway bed. At each end of the rakehead there is to be found an adjustable width gauge component with a chair shaped end for facilitating the construction of either a three foot wide or up to four foot wide walkway. Each width gauge component fits snugly to a frontal portion of the rakehead. The rakehead is characterized by the presence of a pair of slits emanating from each of which is a pair of threaded posts attached to each width gauge component. Each post is amenable to being tightened against the rakehead by way of threaded wingnuts. Pulling medially or pushing laterally a given distance on one and then doing the same with respect to a post on the other width gauge component facilitates appropriate adjustment of the width gauge components in order to in turn facilitate leveling of an wide walkway bed. Each width gauge component has a chair shaped end serving to facilitate a leveling of a bed at a proper height vis a vis the height of lateral support forms. There is built into the rakehead component, an anteroposterior through hole equidistantly positioned from either end of the rakehead component and near the topside thereof through which a nail can be positioned in order to draw a midline groove in a bed of sand meant to become a walkway bed. Finally, affixed to a top side of the rakehead component is an encased leveling bubble component that aids a workman in comprehending the amount of side to side pitch at any point along the length of a walkway bed.

2. Objects of the Invention

The instant invention is uniquely different from other devices utilized to, for example, grade or level surfaces of wet concrete or bedding for roadways or sidewalks. Unlike those situations wherein the finished top surfaces of such wet concrete or bedding are invariably leveled to the same height as the top edges of lateral forms encasing the materials subject to such leveling, the situation involving the laying in or a brick walkway bed requires that the bricks thereof to be placed atop the bed, themselves be in respect of the top sides thereof, an inch higher than the top edges of the lateral forms encasing the bedding of sand or sandy particulate material and such bricks so placed thereupon so that such bedding must actually in the case of walkways be lower than the top edges of the forms. The unique chair shaped ends of the width gauge components of the instant invention permit the laying in bedding that is an inch lower than the level of the top edges of the encasing lateral forms. In this way, bricks that are invariably two and a quarter inches high can be compressed through a distance of an inch and a quarter into the walkway bed everywhere throughout the walkway, compression of an inch and a quarter being what is considered optimal for purposes of ensuring snug and even, permanent and lasting embedding of bricks with top sides thereof being then an inch above the top edges of such lateral support forms. Also, the unique mediolateral adjustability of the width gauge components uniquely permits ready construction of three foot wide and up to four foot wide inlaid brick walkways. Finally, the encased leveling bubble component of the instant invention allows a workperson to ultimately construct a walkway bed with a slight side to side pitch to allow for the runoff of water from the top sides of inlaid bricks on stormy days.

Respectfully submitted, the instant invention is indeed new, useful and unique as respects the matter of construction of inlaid brick walkway beds and in turn inlaid brick walkways.

A DESCRIPTION OF THE DRAWINGS

1. FIG. 1 is an exploded perspective view of the instant invention.

Figure 2:
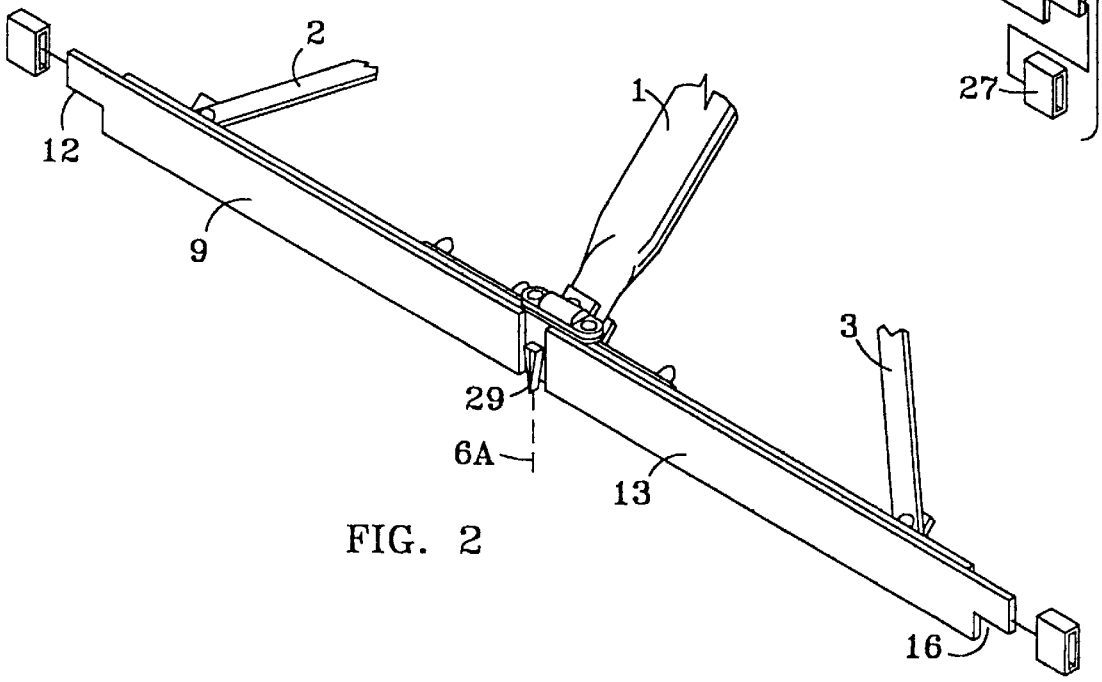

2. FIG. 2 is a perspective view of the instant invention depicting in particular the encased leveling bubble component thereof.

Figure 3A:
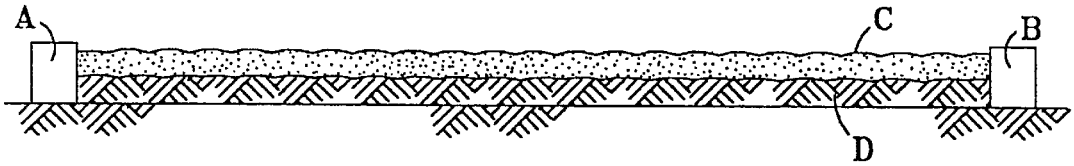

3A. FIG. 3A is a frontal plan view of a walkway bed between lateral forms.

Figure 3B:
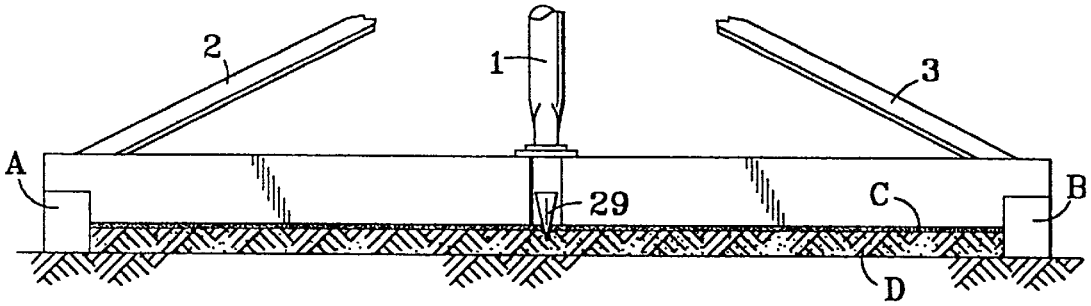

3B. FIG. 3B illustrates in frontal plan view application of the instant invention to a walkway bed.

Figure 3C:
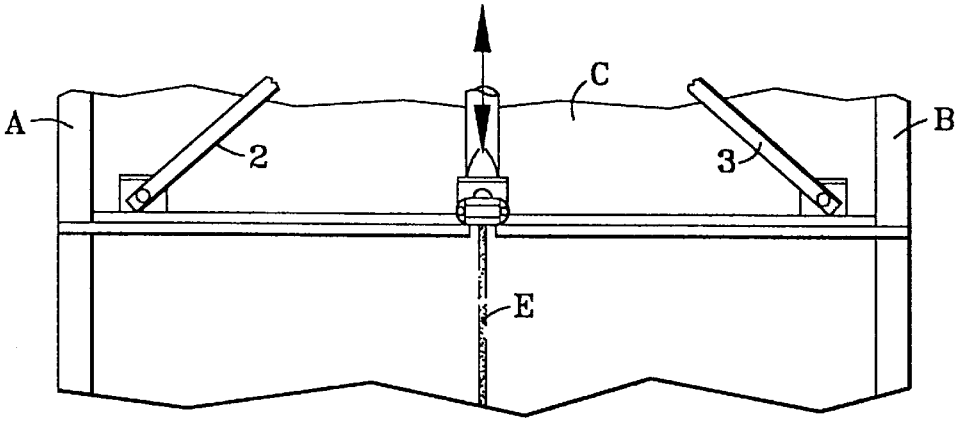

3C. FIG. 3C illustrates in top plan view application of the instant invention to a walkway bed.

Figure 3D:
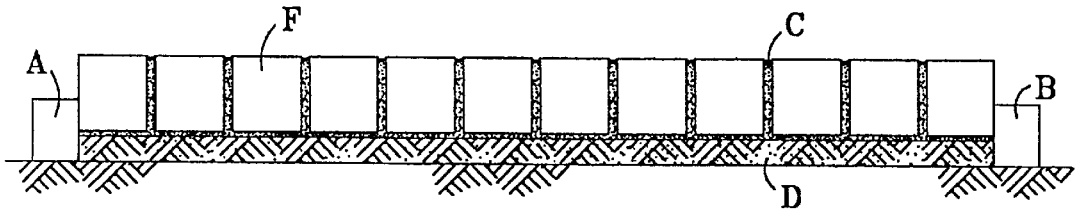

3D. FIG. 3D is a frontal plan view of a leveled walkway bed between lateral forms in receipt of inlaid bricks.

Figure 4:
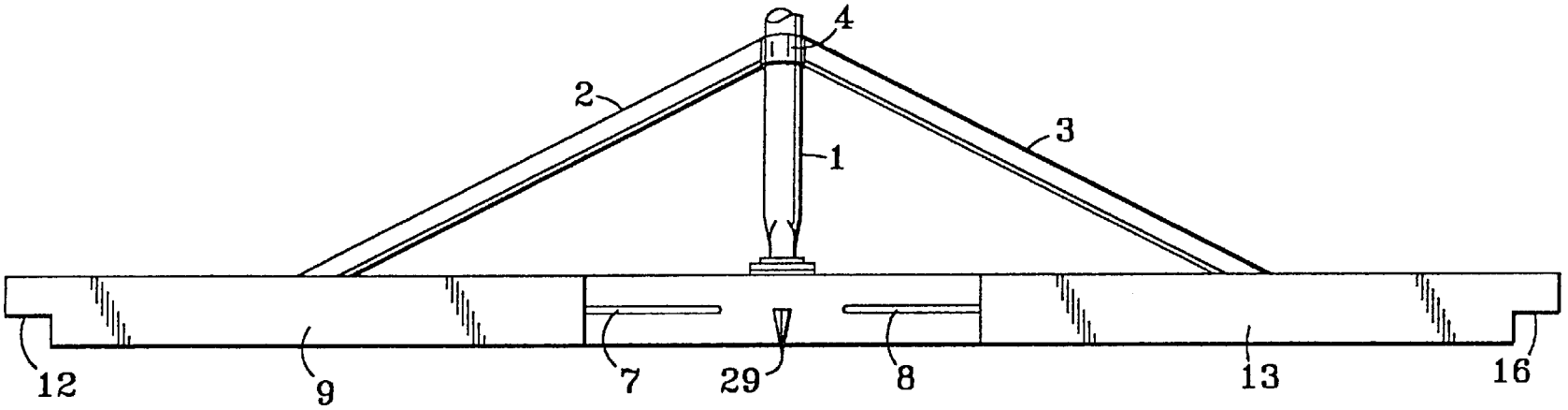

4. FIG. 4 is a frontal plan view of the instant invention illustrating the slideability of the width gauge component thereof.

Figure 5:
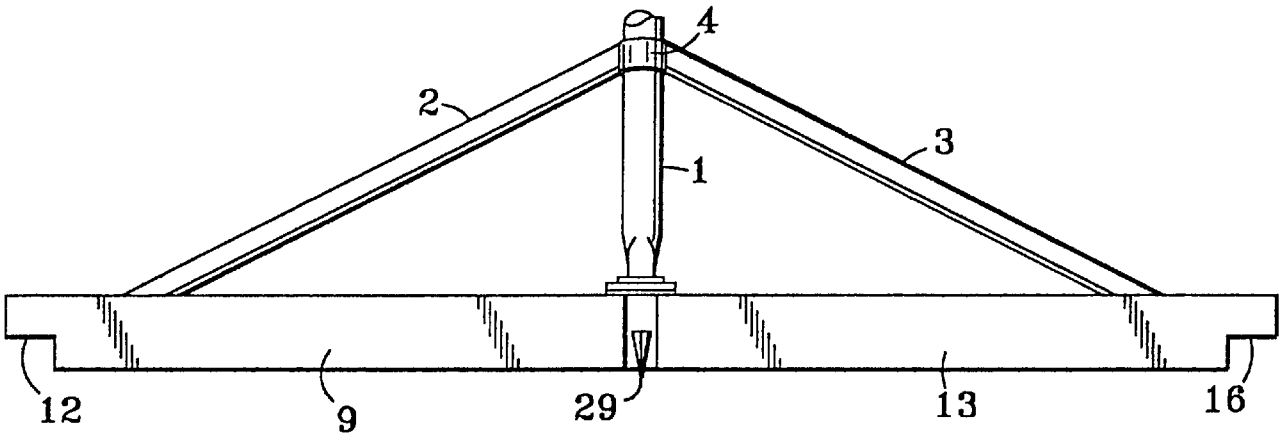

FIG. 5 is a frontal plan view of the instant invention with width gauge components not at all slid sideways.

Figure 6:
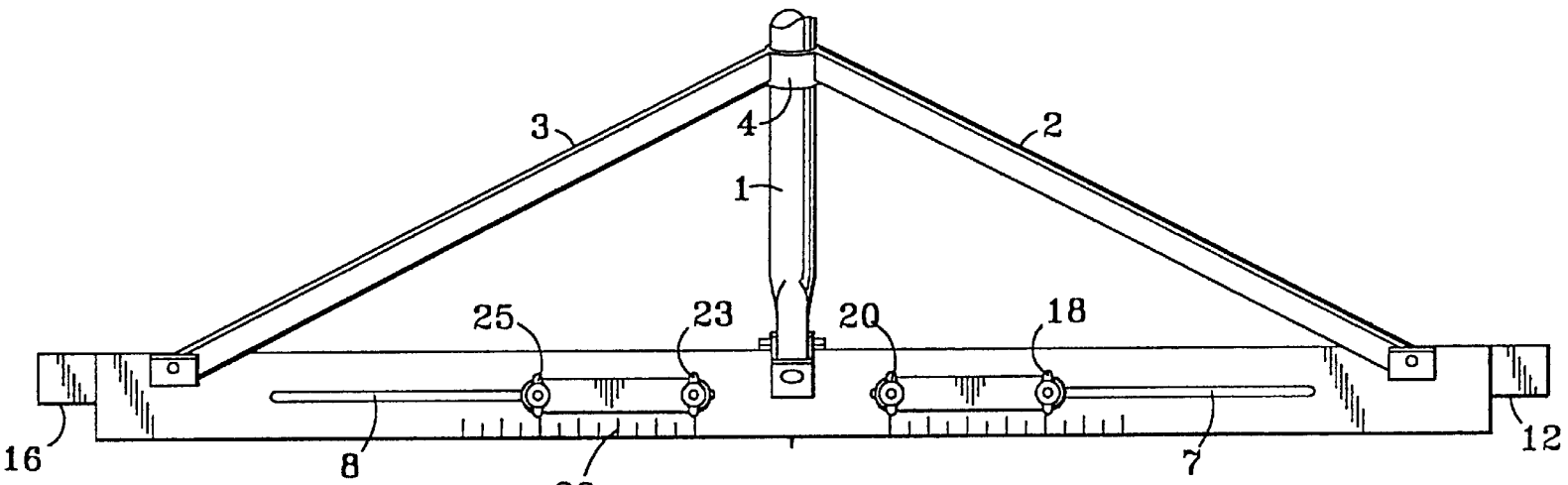

6. FIG. 6 is a rear plan view of the instant invention.

Figure 7:
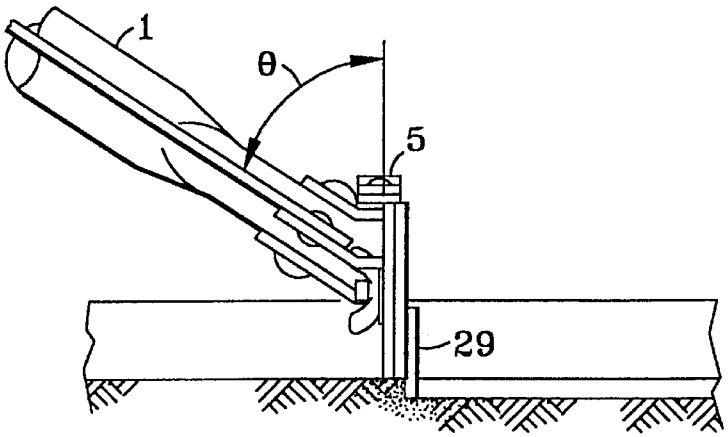

7. FIG. 7 is an isolated lateral plan view depicting the angular attachment of the elongated handle component of the instant invention to the rakehead component thereof.

Figure 8:
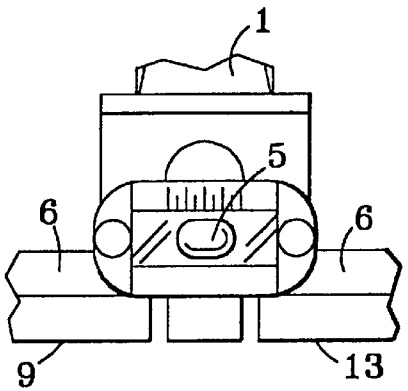

8. FIG. 8 is an isolated top plan view of the encased leveling bubble component of the instant invention.

Figure 9:
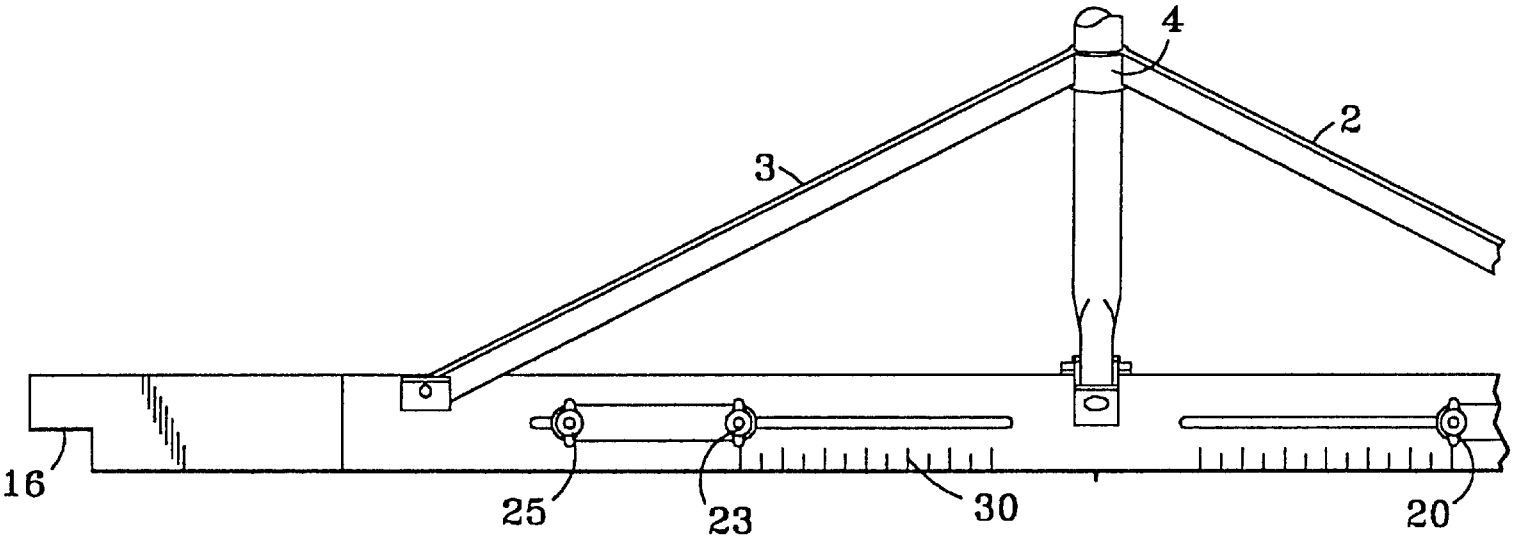

9. FIG. 9 is a rear plan view of the instant invention illustrating the slideability of a width gauge component.

Figure 10:
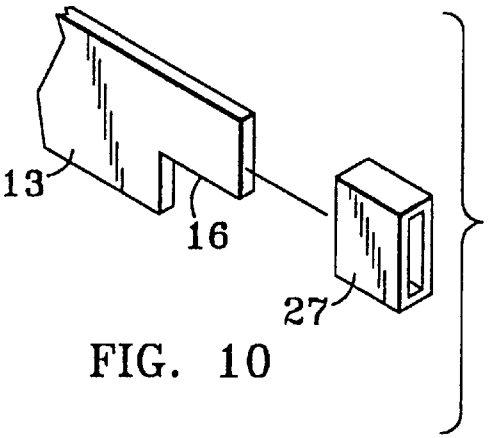

10. FIG. 10 is an isolated perspective view of a clip component in apposition to a chair shaped end of a width gauge component.

Figure 11:
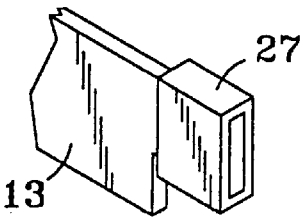

11. FIG. 11 is an isolated perspective view of a clip component affixed to a chair shaped end of a width gauge component.

A DESCRIPTION OF THE PREFERRED EMBODIMENTS

FIG. 3A depicts an unleveled walkway initially laid in for ultimate receipt of bricks. Gravel bedding D is laid in between lateral forms A and B. Atop bedding D there is to be found a bed of sand C. The width gauge components 9 and 13 of the instant invention are adjusted to the equivalent of a particularly desired walkway width as illustrated with resort to a viewing of FIGS. 4 and 5. The chair shaped ends of each width gauge components 9 and 13, namely ends 12 and 16 rest atop lateral forms A and B respectively as seen in FIG. 3B for purposes of enabling leveling to occur such that sand bedding C and gravel bedding D in toto are level to a distance of one inch below the level of the top edges of lateral forms A and B. The laying in of a brick walkway requires initially that once bedding has been lain as set forth above, that the bedding as noted above also be leveled once again as noted above, but with respect to the need to first draw a midline from one end of a proposed walkway to the other. FIG. 3C illustrates how when a worker draws the instant invention along a walkway bed from front to back, crooked nail 29 insertable through anteroposterior hole 28 as seen in FIG. 1 facilitates the drawing of such a walkway midline E as seen in FIG. 3C. Midline E is a reference line that enables a worker to gauge just how many bricks F to lay into bedding C on either side thereof between lateral forms A and B extending from the front edge of the walkway to its back edge, since bricks such as are utilized for such purposes are virtually universally eight inches long by three inches wide and two and one-quarter inches high. Bricking F laid in a previously leveled walkway bed C, to wit, so previously leveled with resort to utilization of the instant invention as depicted with resort to FIGS. 3B and 3C can be seen with resort to FIG. 3D. As noted above, chair shaped ends 12 and 16 of width gauge components 9 and 13 respectively serve to ensure that the levels of the top edges of brick F will be an inch above the levels of forms A and B everywhere throughout the span of the walkway thereby ascribing an uniquely aesthetic character to the walkway whereas each Brick F will be deftly press-fitted into bedding C to a depth of one and a quarter inches before grouting takes place. All of the features and component parts of the instant invention can be seen with resort to FIG. 1. Therein, there can be seen an elongated handle 1, angularly affixed to a four sided rakehead 6 a bottom side of which is straight as can be more particularly seen in FIG. 7. First strut 2 and second strut 3 are affixed by way of bracing 4 to elongated handle 1 and to opposites sides of rakehead 6 at points equidistant from a vertically inclined central axis of symmetry 6A of rakehead 6 as can be noted with continuing reference to FIG. 1. Struts 2 and 3 serve to stabilize handle 1 as it is attached to rakehead 6. An encased leveling bubble component 5 is affixed to a top edge of rakehead 6. Leveling bubble component 5 serves to enable a worker once lateral forms A and B are laid down and with the aid of removable clip component 27 as seen in FIGS. 1 and 11, a hollowed out component with a measure of depth to then proceed to a leveling of bedding D and C so that the bedding has a measure of side to side pitch such that bricks laid therein will be characterized by similar pitch to thereby provide a means for ready side to side runoff of water impacting the top sides of bricking F on rainy days. FIGS. 2, 10 and 11 illustrate the removable affixability of clip component 27 to chair shaped end 12 or chair shaped end 16 of width gauge components 9 and 13. Encased leveling bubble component 5 is seen in greater detail in FIG. 8. There are also seen in FIG. 1 a pair of elongated slits 7 and 8 in rakehead 6 as well as first adjustable width gauge component 9 with perpendicularly attached threaded posts 10 and 11 and second adjustable width gauge component 13 with perpendicularly attached threaded posts, 14 and 15. Posts 10 and 11 fit through slit 7 and posts 14 and 15 fit through slit 8 for receipt by washers 17, 19, 22 and 24 respectively and equivalent threaded means such as threaded wingnuts 18, 20, 23 and 25 respectively as well. Posts 10 and 11 are so received by washers 17 and 19 and wingnuts 18 and 20 through holes near each end of first bicannular post holder 21. Posts 14 and 15 are so received by washers 22 and 24 and wingnuts 23 and 25 through holes near each end of second bicannular post holder 26. FIG. 6 serves to illustrate the manner in which wingnuts through holes in bicannular post holders and washers can serve to tighten posts and accordingly width gauge components fast to a front face of rakehead 6. Such tightening occurs once respective width gauge components 9 and 13 are moved equally mediolateially as illustrated in FIG. 9 in order to match up with regards to chair shaped ends 12 and 16 thereof to the top edges of lateral forms A and B separated by a predetermined distance of between three and four feet depending upon the predetermined desired width of the walkway to be constructed. Optional markings 30 etched onto the posterior side of rakehead 6 facilitate the setting of width gauge components 9 and 13 to mediolateral settings conducive to accommodating a desired walkway width.

Respectfully submitted, the foregoing recitations evidence an invention that is not merely new, useful and unique but indeed one that is veritably revolutionary in respect of the art of constructing inlaid brick walkways.

What is claimed is:

1. An inlaid brick walkway leveler, comprising:

a. a four sided rakehead with a straight bottom side;

b. an elongated handle angularly affixed to said rakehead;

c. a first strut;

d. a second strut;

e. said first strut and said second strut being affixed to said elongated handle;

f. said first strut being affixed to said rakehead near a first end thereof and said second strut being affixed to said rakehead near a second end thereof with a point of affixation to said rakehead of said first strut and a point of affixation to said rakehead of said second strut being equidistant from a locus of a vertically inclined central axis of symmetry of said rakehead;

g. an encased leveling bubble component affixed to a top edge of said rakehead above said locus of said vertically inclined central axis of symmetry of said rakehead;

h. a first elongated slit in said rakehead;

i. a second elongated slit in said rakehead;

j. a first adjustable width gauge component;

k. a second adjustable width gauge component;

l. a first pair of threaded posts perpendicularly affixed to said first adjustable width gauge component with each of said first pair of threaded posts being receivable through said first elongated slit;

m. a second pair of threaded posts perpendicularly affixed to said second adjustable width gauge component with each of said second pair of threaded posts being receivable through said second elongated slit;

n. one end of said first adjustable width gauge component being chair shaped;

o. one end of said second adjustable width gauge component being chair shaped;

p. an anteroposterior through hole near said top edge of said rakehead located within said locus of said vertically inclined central axis of symmetry of said rakehead;

q. a crooked nail receivable by said anteroposterior hole;

r. a hollow end clip component with depth affixable to said one end of said first adjustable width gauge component or said one end of said second adjustable width gauge component, and;

s. a plurality of equivalent threaded tightening means for tightening said first width gauge component and said second width gauge component fast to a front side of said rakehead by way of tightening one member of said plurality of equivalent threaded tightening means to one of each member of said first pair of threaded posts extending through said first slit, one member of said plurality of equivalent threaded tightening means per member of said first pair of threaded posts and by way of tightening a member of said plurality of equivalent threaded tightening means to one of each member of said second pair of threaded posts extending through said second slit, one member of said plurality of equivalent threaded tightening means per member of said second pair of threaded posts.

2. The inlaid brick walkway leveler of claim 1 whereby one of a plurality of equivalent porous washer units is placed behind each one of a first pair of through holes in a first bicannular post holder for receipt of one each of said first pair of threaded posts anterior to a locus of receipt of said one each of said first pair of threaded posts by said one of said plurality of equivalent threaded means and behind each one of a second pair of through holes in a second bicannular post holder for receipt of one each of said second pair of threaded posts anterior to a locus of receipt of said one each of said second pair of threaded posts by another said one of said plurality of equivalent threaded means.

3. The inlaid brick walkway leveler of claim 1 whereby markings are etched onto a posterior side of said rakehead.

4. An inlaid brick walkway leveler, comprising:

a. a four sided rakehead with a straight bottom side;

b. an elongated handle angularly affixed to said rakehead;

c. a first strut;

d. a second strut;

e. said first strut and said second strut being affixed to said elongated handle;

f. said first strut being affixed to said rakehead near a first end thereof and said second strut being affixed to said rakehead near a second end thereof with a point of affixation to said rakehead of said first strut and a point of affixation to said rakehead of said second strut being equidistant from a locus of a vertically inclined central axis of symmetry of said rakehead;

g. an encased leveling bubble component affixed to a top edge of said rakehead above said locus of said vertically inclined central axis of symmetry of said rakehead;

h. a first elongated slit in said rakehead;

i. a second elongated slit in said rakehead;

j. a first adjustable width gauge component;

k. a second adjustable width gauge component;

l. a first pair of threaded posts perpendicularly affixed to said first adjustable width gauge component with each of said first pair of threaded posts being receivable through said first elongated slit;

m. a second pair of threaded posts perpendicularly affixed to said second adjustable width gauge component with each of said second pair of threaded posts being receivable through said second elongated slit;

n. one end of said first adjustable width gauge component being chair shaped;

o. one end of said second adjustable width gauge component being chair shaped;

p. an anteroposterior through hole near said top edge of said rakehead located within said locus of said vertically inclined central axis of symmetry of said rakehead;

q. a crooked nail receivable by said anteroposterior hole;

r. a hollow end clip component with depth affixable to said one end of said first adjustable width gauge component or said one end of said second adjustable width gauge component, and;

s. a plurality of equivalent threaded wingnuts for tightening said first width gauge component and said second width gauge component fast to a front side of said rakehead by way of tightening a member of said plurality of equivalent threaded wingnuts to each member of said first pair of threaded posts extending through said first slit, one member of said plurality of equivalent threaded wingnuts per member of said first pair of threaded posts and by way of tightening one of said plurality of equivalent threaded wingnuts to each member of said second pair of threaded posts extending through said second slit, one member of said plurality of equivalent threaded wingnuts per member of said second pair of threaded posts.

5. The inlaid brick walkway leveler of claim 4 whereby one of a plurality of equivalent porous washer units is placed behind each one of a first pair of through holes in a first bicannular post holder for receipt of one each of said first pair of threaded posts anterior to a locus of receipt of said one each of said first pair of threaded posts by said one of said plurality of equivalent threaded wingnuts and behind each one of a second pair of through holes in a second bicannular post holder for receipt of one each of said second pair of threaded posts anterior to a locus of receipt of said one each of said second pair of threaded posts by another said one of said plurality of equivalent threaded wingnuts.

6. The inlaid brick walkway leveler of claim 4 whereby markings are etched onto a posterior side of said rakehead.

7. An inlaid brick walkway leveler, comprising:

a. a four sided rakehead with a straight bottom side;

b. an elongated handle angularly affixed to said rakehead;

c. a first strut;

d. a second strut;

e. said first strut and said second strut being affixed to said elongated handle;

f. said first strut being affixed to said rakehead near a first end thereof and said second strut being affixed to said rakehead near a second end thereof with a point of affixation to said rakehead of said first strut and a point of affixation to said rakehead of said second strut being equidistant from a locus of a vertically inclined central axis of symmetry of said rakehead;

g. an encased leveling bubble component affixed to a top edge of said rakehead above said locus of said vertically inclined central axis of symmetry of said rakehead;

h. a first elongated slit in said rakehead;

i. a second elongated slit in said rakehead;

j. a first adjustable width gauge component;

k. a second adjustable width gauge component;

l. a first pair of threaded posts perpendicularly affixed to said first adjustable width gauge component with each of said first pair of threaded posts being receivable through said first elongated slit;

m. a second pair of threaded posts perpendicularly affixed to said second adjustable width gauge component with each of said second pair of threaded posts being receivable through said second elongated slit;

n. one end of said first adjustable width gauge component being chair shaped;

o. one end of said second adjustable width gauge component being chair shaped;

p. an anteroposterior through hole near said top edge of said rakehead located within said locus of said vertically inclined central axis of symmetry of said rakehead;

q. a crooked nail receivable by said anteroposterior hole;

r. a hollow end clip component with depth affixable to said one end of said first adjustable width gauge component or said one end of said second adjustable width gauge component;

s. a first bicannular post holder;

t. a second bicannular post holder;

u. a plurality of equivalent threaded means for tightening said first width gauge component and said second width gauge component fast to a front said of said rakehead by way of tightening one member of said plurality of equivalent threaded means to each member of said first pair of threaded posts extending through said first slit and through one each of a pair of first bicannular post holder through holes, one said member of said first pair of threaded posts per said one of said pair of first bicannular post holder through holes and by way of a tightening a member of said plurality of equivalent threaded means to each member of said second pair of threaded posts extending through said second slit and through one each of a pair of second bicannular post holder through holes, one said member of said second pair of threaded posts per said one of said pair of second bicannular post holder through holes.

8. The inlaid brick walkway leveler of claim 7 whereby markings are etched onto a posterior side of said rakehead.

9. An inlaid brick walkway leveler, comprising:

a. a four sided rakehead with a straight bottom side;

b. an elongated handle angularly affixed to said rakehead;

c. a first strut;

d. a second strut;

e. said first strut and said second strut being affixed to said elongated handle;

f. said first strut being affixed to said rakehead near a first end thereof and said second strut being affixed to said rakehead near a second end thereof with a point of affixation to said rakehead of said first strut and a point of affixation to said rakehead of said second strut being equidistant from a locus of a vertically inclined central axis of symmetry of said rakehead;

g. an encased leveling bubble component affixed to a top edge of said rakehead above said locus of said vertically inclined central axis of symmetry of said rakehead;

h. a first elongated slit in said rakehead;

i. a second elongated slit in said rakehead;

j. a first adjustable width gauge component;

k. a second adjustable width gauge component;

l. a first pair of threaded posts perpendicularly affixed to said first adjustable width gauge component with each of said first pair of threaded posts being receivable through said first elongated slit;

m. a second pair of posts perpendicularly affixed to said second adjustable width gauge component with each of said second pair of threaded posts being receivable through said second elongated slit;

n. one end of said first adjustable width gauge component being chair shaped;

o. one end of said second adjustable width gauge component being chair shaped;

p. an anteroposterior through hole near said top edge of said rakehead located within said locus of said vertically inclined central axis of symmetry of said rakehead;

q. a crooked nail receivable by said anteroposterior hole;

r. a hollow end clip component with depth affixable to said one end of said first adjustable width gauge component or said one end of said second adjustable width gauge component;

s. a first bicannular post holder;

t. a second bicannular post holder;

u. a plurality of equivalent threaded wingnuts for tightening said first width gauge component and said second width gauge component fast to a front said of said rakehead by way of tightening one member of said plurality of equivalent threaded wingnuts to each member of said first pair of threaded posts extending through said first slit and through one each of a pair of first bicannular post holder through holes, one said member of said first pair of threaded posts per said one of said pair of fist bicannular post holder through holes and by way of a tightening a member of said plurality of equivalent threaded wingnuts to each member of said second pair of threaded posts extending through said second slit and through one each of a pair of second bicannular post holder through holes, one said member of said second pair of threaded posts per said one of said pair of second bicannular post holder through holes.

10. The inlaid brick walkway leveler of claim 9 whereby markings are etched onto a posterior side of said rakehead.

* * * * *